US006755060B2

(12) United States Patent
Häggström

(10) Patent No.: US 6,755,060 B2
(45) Date of Patent: Jun. 29, 2004

(54) METHOD AND DEVICE FOR FASTENING A LOCK BODY

(75) Inventor: Åke Häggström, Lycksele (SE)

(73) Assignee: Assa AB, Eskilstuna (SE)

( * ) Notice: Subject to any disclaimer, the term of this patent is extended or adjusted under 35 U.S.C. 154(b) by 0 days.

(21) Appl. No.: 10/149,609

(22) PCT Filed: Dec. 14, 2000

(86) PCT No.: PCT/SE00/02535

§ 371 (c)(1),
(2), (4) Date: Jun. 14, 2002

(87) PCT Pub. No.: WO01/44603

PCT Pub. Date: Jun. 21, 2001

(65) Prior Publication Data

US 2002/0189308 A1 Dec. 19, 2002

(30) Foreign Application Priority Data

Dec. 16, 1999 (SE) ..... 9904618

(51) Int. Cl.[7] ..... E05B 9/08

(52) U.S. Cl. ..... 70/370; 70/466; 292/DIG. 53; 292/DIG. 64

(58) Field of Search ..... 70/370, 466, 451; 292/DIG. 53, DIG. 54, DIG. 64

(56) References Cited

U.S. PATENT DOCUMENTS

| | | | | | |
|---|---|---|---|---|---|
| 2,040,258 | A | * | 5/1936 | Jacobi | 70/370 |
| 2,124,736 | A | * | 7/1938 | Jacobi | 70/74 |
| 4,576,023 | A | * | 3/1986 | Crepinsek | 70/137 |
| 4,586,354 | A | * | 5/1986 | Smith | 70/451 |
| 5,251,467 | A | * | 10/1993 | Anderson | 70/370 |
| 5,435,159 | A | * | 7/1995 | Ramsauer | 70/370 |
| 5,457,975 | A | * | 10/1995 | Berger et al. | 70/370 |
| 5,548,981 | A | * | 8/1996 | Kirk | 70/58 |
| 5,551,268 | A | * | 9/1996 | Carnes et al. | 70/370 |
| 5,636,540 | A | * | 6/1997 | Myers | 70/370 |
| 5,931,035 | A | * | 8/1999 | Bolton | 70/367 |
| 5,987,942 | A | * | 11/1999 | Ichinose | 70/208 |
| 6,494,066 | B2 | * | 12/2002 | Muneta | 70/208 |
| 6,502,439 | B1 | * | 1/2003 | Stirling et al. | 70/370 |
| 6,595,033 | B1 | * | 7/2003 | Hara et al. | 70/370 |

FOREIGN PATENT DOCUMENTS

| | | |
|---|---|---|
| DE | 546049 | 2/1932 |
| EP | 0634546 | 1/1995 |
| GB | 668149 | 3/1952 |
| WO | 98/00267 | 1/1998 |

* cited by examiner

*Primary Examiner*—John B. Walsh
(74) *Attorney, Agent, or Firm*—Sughrue Mion, PLLC

(57) ABSTRACT

A method of fastening a lock cylinder body in a generally flat element comprises the steps of providing in the element (20) an opening (22) which is defined by at least first and second mutually convergent edges **(24*a*, 24*b*), and providing in the body (10) first and second grooves (14*a*, 14*b*) that are intended for co-action with said edges. The body is then inserted into the opening (22) to a position in which the grooves are level with said edges, whereafter the body is moved in a direction parallel with the plane of the element into an engagement position in which the edges are in engagement with the grooves, therewith to lock the body in an axial direction in this engagement position. Finally, a tongue (26) integral with the flat element is bent to a position in which the tongue lies essentially in the plane of said flat element, so as to lock the body (10) against movement in directions parallel with the plane of the element (20)** in said engagement position. The lock cylinder body is fastened simply and reliably by means of this method.

8 Claims, 2 Drawing Sheets

METHOD AND DEVICE FOR FASTENING A LOCK BODY

FIELD OF INVENTION

The present invention relates generally to a method and to a device for fastening a body, and more specifically to fastening a lock cylinder body in an essentially flat element, such as a perforated plate.

BACKGROUND OF THE INVENTION

In the case of cylinder locks housed in lock housings for instance, it is necessary to fasten the lock cylinder in the lock housing in some way or another, e.g. with the aid of the cover plate. An example of such fastener means is described in UK Patent Publication No. 668149. This publication describes a lock cylinder in which two non-parallel mutually converging sides are each provided with a groove or channel. A plate is moveably mounted in the lock housing, such that the defining sides of an opening in the plate will engage with the grooves or channels in the lock cylinder when the plate is located in one end position. The plate is held in this position by means of a screw and a link arrangement which engages in an oblique groove or channel in the plate.

Although the arrangement described in the aforesaid publication fulfils its function, i.e. it holds the lock cylinder in place, the arrangement includes many components that add to the overall cost. Moreover, fitting of the lock cylinder is time consuming, as it is necessary to turn the screw from one end position to another in order to move the plate to a desired position and therewith fasten the lock cylinder in place.

A similar arrangement is described in German Patent Specification No. 546049.

International Patent Application WO 98/00267 teaches a method of fastening the handle of a car door. The handle includes a number of flanges and a locking tongue that is adapted to engage in an opening in the door. No part of the actual handle enters the opening and consequently the resistance and structural strength required in lock applications where security is an important aspect is not achieved with this known solution.

SUMMARY OF THE INVENTION

One object of the present invention is to provide a method of fastening a body, particularly a lock component, in a generally flat element, where fastening of said body can be achieved more simply and in less time than in the case of known body fastening means.

Another object of the invention is to provide a body fastening device that comprises fewer component parts than known devices.

The invention exploits the realisation that the body to be fastened may engage directly with the flat element in which the component shall be fastened.

Accordingly, the invention provides a body fastening method as defined in claim 1.

Moreover, the invention provides a body fastening device as defined in claim 8.

The problems associated with known solutions of this kind are solved by the inventive method and inventive device. Thus, the invention enables a locking body to be fitted quickly and easily without requiring any additional elements to achieve positive and reliable fastening of the body.

BRIEF DESCRIPTION OF THE DRAWINGS

The invention will now be described in more detail by way of example and with reference to the accompanying drawings, in which.

DESCRIPTION OF PREFERRED EMBODIMENTS

A preferred embodiment of the invention is described below with reference to the drawings. The lock cylinder is shown in the absence of the cylinder core and other cylinder lock components. These components have been excluded in order to accentuate the characteristic features of the invention.

Figure 1A:
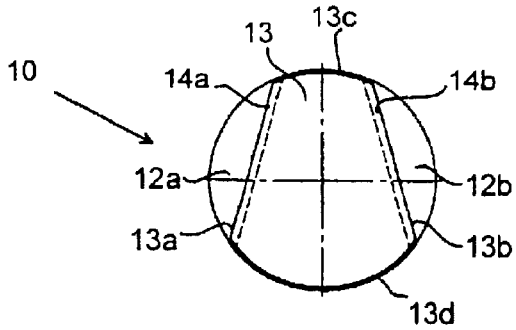
FIGS. 1*a–c* are respectively a rear view, a side view and a perspective view of a lock cylinder according to the invention.
Figure 1B:
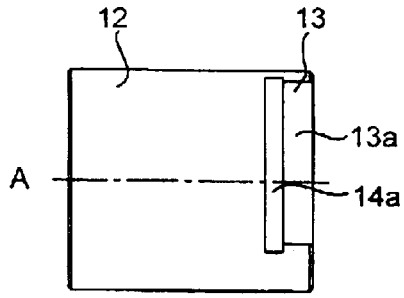
Figure 1C:
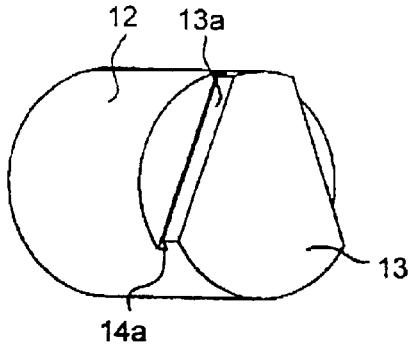

FIGS. 1*a–c* illustrate a lock cylinder, generally referenced 10, that includes a generally cylindrical part 12 having a longitudinal axis A and an insertion part 13 which is disposed in the axial extension of the cylindrical part and the cross-sectional shape of which will best be seen from FIG. 1*a*. As will be seen from FIG. 1*a*, the cylindrical part 12 has an end surface 12*a*, 12*b* which faces towards the insertion part 13.

The insertion part 13 has a top and a bottom side 13*c* and 13*d* respectively whose respective shapes correspond generally to the barrel surface of the cylindrical part 12. The insertion part 13 also includes two straight sides 13*a* and 13*b*, hereinafter referred to commonly as the engagement sides. The straight sides extend between the top and bottom sides in non-parallel paths, i.e. are mutually convergent upwards in the figure. Each of the engagement sides 13*a*, 13*b* includes a respective groove 14*a*, 14*b*. The function of these grooves will be described below.

Figure 2A:
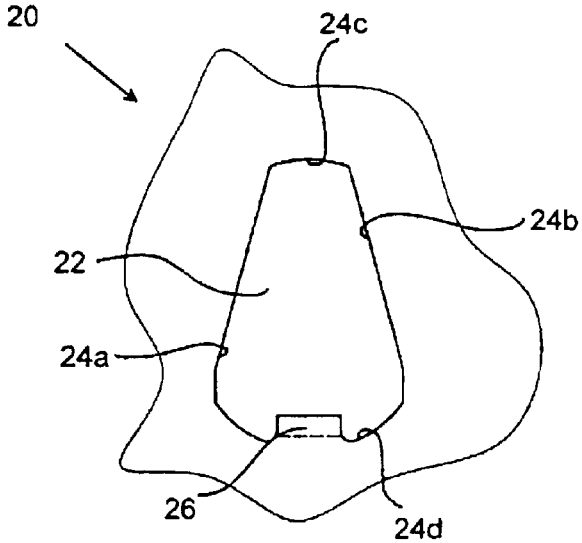
FIGS. 2*a* and 2*b* are respectively a rear view and a side view of a door mounted cover plate.
Figure 2B:
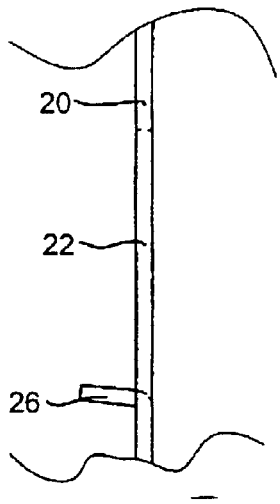

FIGS. 2*a* and 2*b* show a part of a generally flat door plate or cover plate for a lock housing The plate 20 has an opening defined by an upper edge 24*c*, a bottom edge 24*d* and two generally straight edges 24*a*, 24*b*, hereinafter referred to commonly as engagement edges. The engagement edges 24*a*, 24*b* extend relative to one another at an angle which corresponds essentially to the relative angle of the engagement sides 13*a*, 13*b* of the insertion part 13. This angle is about 15–90 degrees, preferably 15–45 degrees, in the case of the preferred embodiment. The size of the opening 22 is such as to allow the insertion part 13 to be inserted into the opening.

The bottom edge 24*d* of the opening 22 includes a tongue or tab 26 formed integrally with the plate 20. In FIGS. 2*a* and 2*b*, the tongue 26 is shown bent through an angle of about 90° from the plane of the plate 20. The thickness of the plate corresponds generally to the width of the grooves 14*a*, 14*b* in the insertion part 13 of the lock cylinder 10.

Figure 3:
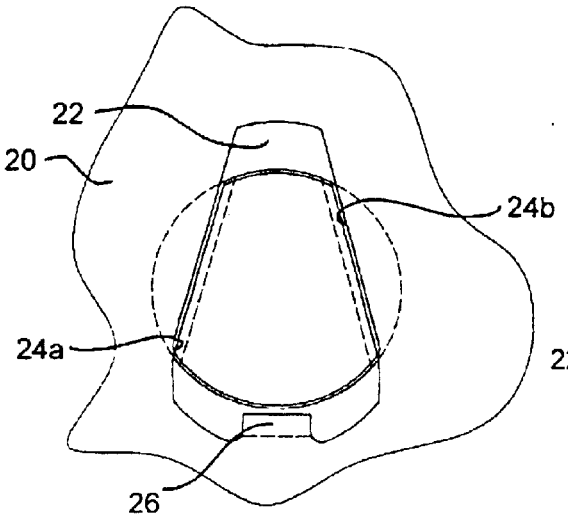
FIG. 3 is a rear view of the lock cylinder shown in FIG. 1 and shows the lock cylinder inserted into the cover plate of FIG. 2 but not fixed therein.

FIG. 3 shows the cylinder housing 10 inserted into the opening 22, but not fixed therein. It will be evident from FIG. 3 that the profile of the insertion part 13 is adapted for insertion into the opening 22, i.e. its width is slightly smaller than the distance between the engagement edges 24*a*, 24*b* in the lower part of the opening. However, it is necessary for the tongue 26 to be bent in the way shown in the figure, in order to be able to insert the insertion part.

Fastening of the lock cylinder will now be described.

In an initial fastening position, the plate has the configuration shown in FIGS. 2*a* and 2*b*, i.e. the tongue 26 is bent. As will be understood, the opening 22 has first been punched from the plate 20 and the tongue 26 then bent to the desired angle. The insertion part 13 of the lock cylinder 10 is then inserted through the opening 22 until the end surface 12*a*, 12*b* of the cylindrical part 12 is impeded, i.e. lies against the plate. As before mentioned, it is necessary to insert the lock cylinder into the lower part of the opening 22, where the engagement edges 24*a*, 24*b* of said opening are spaced more widely apart. This spacing thus exceeds the relative distance between the engagement sides 13*a*, 13*b* of the insertion part; see FIG. 3.

Figure 4:
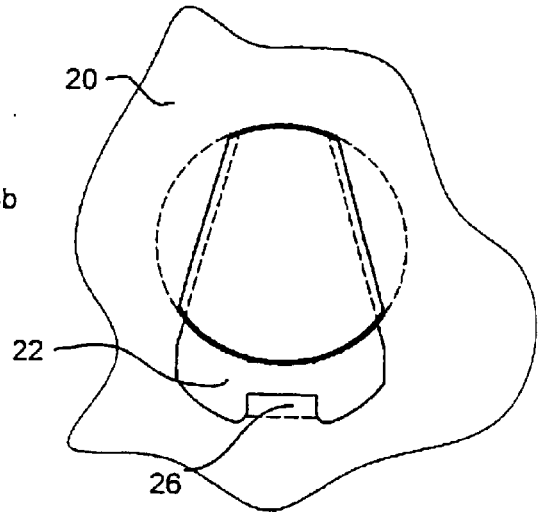
FIG. 4 is a rear view of the lock cylinder in FIG. 1 and shows the lock cylinder moved to a fastening position in the cover plate of FIG. 2 but not fixed therein.
Figure 5A:
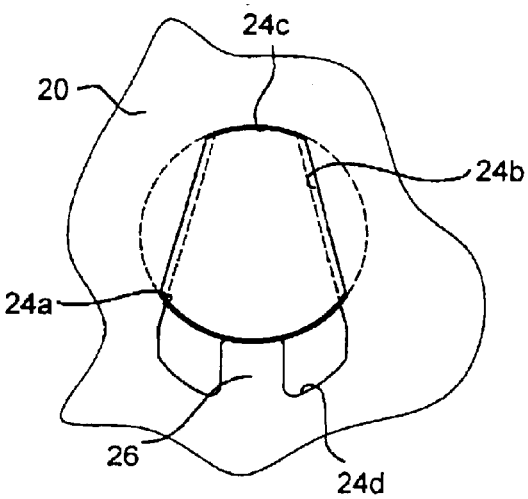
FIGS. 5*a* and 5*b* are respectively a rear view and a side view showing the lock cylinder fastened in the cover plate.
Figure 5B:
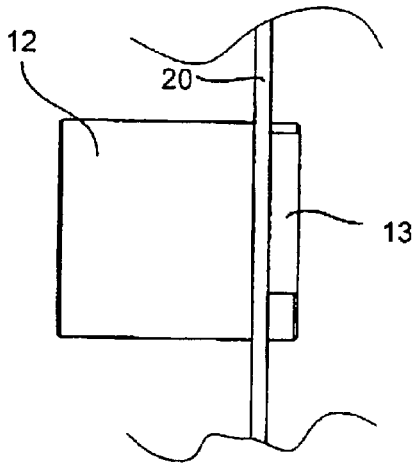

With the cylindrical part 12 lying in abutment with the plate 20, the lock cylinder 10 is moved up in the opening 22 until the upper side 13*c* of the insertion part 13 lies against the upper edge 24*c* of said opening, in the position shown in FIGS. 5*a* and 5*b*. In this position, the relative distance between the engagement sides 13*a*, 13*b* of the insertion part 13 exceeds the relative distance between the engagement edges 24*a*, 24*b* of the opening 22. This is made possible by the grooves 14*a*, 14*b* provided in the insertion part 13, said grooves being in engagement with the engagement edges 24*a*, 24*b* of the opening 22 in said position. This will best be seen from FIGS. 4 and 5*a*. The grooves 14*a*, 14*b* thus form a waist which prevents movement of the lock cylinder 10 in the direction of its longitudinal axis when in engagement with the engagement edges 24*a*, 24*b*, i.e. prevents withdrawal of the lock cylinder from the plate opening 22.

The tongue 26 is then bent up to a position in which it is essentially in plane with the remainder of the plate 20. The configuration of the tongue is such that it will lie against the lock cylinder 10 in the position shown in FIGS. 5*a* and 5*b*. This prevents downward movement of the lock cylinder 10, as seen in FIGS. 5*a* and 5*b*. In turn, this means that movement of the lock cylinder 10 relative to the plate 20 is locked both laterally and longitudinally. Fastening of the lock cylinder 10 in the plate 20 has therewith been achieved.

When wishing to release the lock cylinder 10 at a later time, the tongue 26 is again bent. However, the invention is primarily directed to permanent fastening of a body.

Although the invention has been described with reference to a preferred embodiment, it will be understood that variations and modifications can be made within the scope of the accompanying claims. Accordingly, the illustrated insertion part 13 and opening 22 have two generally straight engagement sides and engagement edges respectively. It will be understood that the configurations of the sides can be varied, provided that the engagement edges of the opening 22 will engage the grooves 13*a*, 13*b* and therewith ensure locking of the lock cylinder in its axial direction. For example, the engagement edges 24, 24*b* of the opening 22 may be curved slightly.

In the case of the illustrated embodiment, the tongue 26 is integral with the remainder of the plate 20. In the case of the preferred embodiment, the tongue functions as a means for blocking movement of the lock cylinder 10 parallel with the plane of the plate 20. Alternatively, a loose part that blocks lateral movement of the lock cylinder 10 may be placed in the opening 22.

The tongue 26 has been shown generally in plane with the plate 20 subsequent to having fastened or fixated the lock cylinder. It will be understood that the tongue may have a certain residual angle of some few degrees relative to the plate, even in its cylinder fastening position. The important thing is that the tongue 26 will block lateral movement of the lock cylinder and will not yield or bend back should the lock cylinder be subjected to force.

Although the upper side 13*c* of the insertion part 13 has been shown to lack grooves, it will be understood that this side may also be grooved and therewith have engagement with the upper edge 24*c* of the opening 22.

What is claimed is:

1. A method of fastening a lock cylinder body in a generally flat element, comprising the steps of:

providing in the element (20) an opening (22) which is defined by at least first and second mutually convergent edges (24*a*, 24*b*);

arranging a blocking element (26) in said opening (22), wherein said blocking element is a tongue (26) formed integrally with said flat element (20);

providing in the body (10) first and second grooves (14*a*, 14*b*) for co-action with said first and second edges (24*a*, 24*b*);

inserting the body (10) into the opening (22) such that the grooves (14*a*, 14*b*) will lie flush with the edges (24*a*, 24*b*);

moving the body in a direction parallel with the plane of the element (20) to a position in which said edges (24*a*, 24*b*) engage in said grooves (14*a*, 14*b*), so as to lock the body (10) against axial movement in said engagement position; and bending the tongue (26) to a position in which the tongue lies generally in the plane of said fiat element, so as to lock the body (10) against movement in directions parallel with the plane of said element (20) in said engagement position.

2. A method according to claim 1 in which the step of arranging a blocking element is followed by the step of bending said tongue (26) to an angle, preferably a right angle, to the plane of said flat element (20).

3. A method according to claim 1 in which said convergent edges (24*a*, 24*b*) are generally straight.

4. A method according to claim 3 in which said convergent edges (24*a*, 24*b*) extend at a relative angle of 15–90°.

5. A method according to claim 1 in which said flat element (20) is a door plate or a cover plate of lock housing.

6. A method according to claim 1 in which said lock body (10) is a lock cylinder.

7. The method according to claim 3 in which said convergent edges extend at a relative angle of 15–45°.

8. The method according to claim 2 in which said convergent edges (24*a*, 24*b*) are generally straight.

* * * * *